US011676748B2

(12) United States Patent
Maehara

(10) Patent No.: US 11,676,748 B2
(45) Date of Patent: Jun. 13, 2023

(54) ANISOTROPIC MAGNETIC POWDERS AND METHOD OF PRODUCING THE SAME

(71) Applicant: NICHIA CORPORATION, Anan (JP)

(72) Inventor: Hisashi Maehara, Itano-gun (JP)

(73) Assignee: NICHIA CORPORATION, Anan (JP)

( * ) Notice: Subject to any disclaimer, the term of this patent is extended or adjusted under 35 U.S.C. 154(b) by 211 days.

(21) Appl. No.: 15/387,997

(22) Filed: Dec. 22, 2016

(65) Prior Publication Data

US 2017/0186519 A1 Jun. 29, 2017

(30) Foreign Application Priority Data

Dec. 24, 2015 (JP) ..... JP2015-251846

(51) Int. Cl.
*H01F 1/059* (2006.01)
*B22F 9/18* (2006.01)
(Continued)

(52) U.S. Cl.
CPC ..... *H01F 1/059* (2013.01); *B22F 1/052* (2022.01); *B22F 9/18* (2013.01); *B22F 9/24* (2013.01);
(Continued)

(58) Field of Classification Search
CPC ..... B22F 1/0088; B22F 9/18; B22F 1/0085; B22F 9/22; H01F 1/059; C22C 38/005; C22C 38/12
See application file for complete search history.

(56) References Cited

U.S. PATENT DOCUMENTS 4,765,848 A * 8/1988 Mohri ..... H01F 1/057 148/302
4,820,433 A * 4/1989 Yamamoto ..... G11B 5/70678 252/62.56
(Continued)

FOREIGN PATENT DOCUMENTS

JP H09-97732 A 4/1997
JP 2000049006 A * 2/2000 ..... H01F 1/0596
(Continued)

OTHER PUBLICATIONS

Espacenet machine translation of JP-2000049006-A (Year: 2019).*
(Continued)

*Primary Examiner* — Nicholas A Wang
(74) *Attorney, Agent, or Firm* — Hunton Andrews Kurth LLP

(57) ABSTRACT

A method of producing anisotropic magnetic powders comprising obtaining a precipitate containing an element R, iron and lanthanum from a solution including R, iron and lanthanum, wherein R is at least one selected from the group consisting of Sc, Y, Pr, Nd, Pm, Sm, Gd, Tb, Dy, Ho, Er, Tm and Lu; obtaining an oxide containing R, iron and lanthanum from the precipitate; treating the oxide with a reducing gas to obtain a partial oxide; obtaining alloy particles by reduction diffusion of the partial oxide at a temperature in the range of 920° C. to 1200° C.; and nitriding the alloy particles to produce an anisotropic magnetic powder represented by the following general formula: $R_{v-x}Fe_{(100-v-w-z)}N_wLa_xW_z$, where $3 \leq v-x \leq 30$, $5 \leq w \leq 15$, $0.08 \leq x \leq 0.3$, and $0 \leq z \leq 2.5$.

6 Claims, 4 Drawing Sheets

METHOD FOR PRODUCING ANISOTROPIC MAGNETIC POWDERS

(51) Int. Cl.

| | |
|---|---|
| ***B22F 1/052*** | (2022.01) |
| ***B22F 9/24*** | (2006.01) |
| ***C22C 38/00*** | (2006.01) |
| ***C22C 38/12*** | (2006.01) |

(52) U.S. Cl.

CPC ..... *C22C 38/005* (2013.01); *C22C 38/12* (2013.01); *B22F 2303/01* (2013.01); *B22F 2304/10* (2013.01); *B22F 2998/10* (2013.01); *B22F 2999/00* (2013.01)

(56) References Cited

U.S. PATENT DOCUMENTS

| | | | | |
|---|---|---|---|---|
| 6,334,908 | B1 * | 1/2002 | Kawano | B22F 9/20 148/301 |
| 2005/0067052 | A1 * | 3/2005 | Honkura | C22C 38/002 148/105 |
| 2008/0066575 | A1 * | 3/2008 | Yang | B22F 3/18 75/229 |

FOREIGN PATENT DOCUMENTS

| | | | |
|---|---|---|---|
| JP | 2000-348922 | A | 12/2000 |
| JP | 2001-181713 | A | 7/2001 |
| JP | 2001-230111 | A | 8/2001 |
| JP | 2001313206 | * | 11/2001 |
| JP | 2002-217010 | A | 8/2002 |
| JP | 2004-111515 | A | 4/2004 |
| JP | 2008091873 | * | 4/2008 |
| JP | 2008091873 | A | 4/2008 |
| JP | 2014-080653 | A | 5/2014 |
| JP | 2014-236195 | A | 12/2014 |
| JP | 2014236195 | * | 12/2014 |
| JP | 2015070102 | A | 4/2015 |
| JP | 2015-113481 | A | 6/2015 |

OTHER PUBLICATIONS

Non-Final Office Action, United States Patent and Trademark Office, issued to U.S. Appl. No. 15/980,254 dated Jan. 6, 2021, 11 pages.

Kaszuwara. The effect of tungsten addition on the magnetic properties and microstructure of SmFeN-a-Fe Tanocomposites. Materials Letters 42 2000 383-386 (Year: 2000).

Xue. Study on Preparation of the Precursor of Sm2Fe17 Alloy by Oxalate Co-precipitation. Applied Mechanics and Materials vol. 697 (2015) pp. 118-122 (Year: 2014).

Non-Final Office Action, United States Patent and Trademark Office, issued to U.S. Appl. No. 17/450,451 dated Oct. 27, 2022, 18 pages.

* cited by examiner

ANISOTROPIC MAGNETIC POWDERS AND METHOD OF PRODUCING THE SAME

CROSS-REFERENCE TO RELATED APPLICATIONS

This application claims the benefit of Japanese Patent Application No. 2015-251846 filed on Dec. 24, 2015, the disclosure of which is hereby incorporated by reference in its entirety.

BACKGROUND

Technical Field

The present disclosure relates to anisotropic magnetic powders and methods of producing the same.

Description of the Related Art

Japanese Patent Application Kokai Publication No. 2001-181713 discloses a method of producing a rare earth-iron-nitrogen anisotropic magnetic powder having a substantially spherical shape and a sharp particle size distribution with the particle sizes ranging from about 1 to 5 μm, the method including mixing a rare earth metal oxide with a transition metal oxide while performing crushing, and alloying the metals by reduction diffusion of materials including the crushed powder.

Japanese Patent Application Kokai Publication No. 2002-217010 discloses a method of producing, with improved magnetization, a rare earth-iron-nitrogen anisotropic magnetic powder having a particle size of 2 μm and containing 0.1 to 50 wt % lanthanum, the method including casting a Sm—La—Fe—Mn alloy ingot using a mold, and crushing the ingot.

Japanese Patent Application Kokai Publication No. 2014-080653 discloses a method of producing a rare earth-iron-nitrogen magnetic powder having a relatively small particle size and a uniform composition, the method including reacting a solution including a rare earth compound and a transition metal compound with an alkali solution, oxidizing the resultant precipitate into an oxide, and alloying the metals by reduction diffusion of the oxide.

SUMMARY

According to exemplary embodiments of the present disclosure, a method of producing anisotropic magnetic powders includes:

obtaining a precipitate containing an element R, iron and lanthanum from a solution including R, iron and lanthanum, where R is at least one selected from the group consisting of Sc, Y, Pr, Nd, Pm, Sm, Gd, Tb, Dy, Ho, Er, Tm and Lu;

obtaining an oxide containing R, iron and lanthanum from the precipitate;

treating the oxide with a reducing gas to obtain a partial oxide;

obtaining alloy particles by reduction diffusion of the partial oxide at a temperature in the range of 920° C. to 1200° C.; and nitriding the alloy particles to produce an anisotropic magnetic powder represented by the following general formula:

$$R_{v-x}Fe_{(100-v-w-z)}N_wLa_xW_z$$

where $3 \le v-x \le 30$, $5 \le w \le 15$, $0.08 \le x \le 0.3$, and $0 \le z \le 2.5$.

According to additional exemplary embodiments of the present disclosure, an anisotropic magnetic powder represented by the following general formula:

$$R_{v-x}Fe_{(100-v-w-z)}N_wLa_xW_z$$

where R is at least one selected from the group consisting of Sc, Y, Pr, Nd, Pm, Sm, Gd, Tb, Dy, Ho, Er, Tm and Lu, $3 \le v-x \le 30$, $5 \le w \le 15$, $0.08 \le x \le 0.3$, and $0 \le z \le 2.5$;

wherein the anisotropic magnetic powder has an average particle size of not less than 3.5 μm and not more than 6.2 μm;

wherein the anisotropic magnetic powder has a particle size D10 of not less than 1.6 μm and not more than 2.8 μm;

wherein the anisotropic magnetic powder has a particle size D50 of not less than 3.5 μm and not more than 5.7 μm; and wherein the anisotropic magnetic powder has a particle size D90 of not less than 6.0 μm and not more than 9.5 μm;

wherein the anisotropic magnetic powder has a span of not more than 1.25 according to the following equation:

$$\text{Span}=(D90-D10)/D50,$$

where D90 corresponds to 90%, D10 corresponds to 10%, and D50 corresponds to 50% in a cumulative particle size distribution.

The rare earth-iron-nitrogen anisotropic magnetic powders of the present embodiments have good magnetic characteristics and are resistant to heat. The production methods of the present embodiments can produce such magnetic powders.

DETAILED DESCRIPTION OF EMBODIMENTS

In the methods for the production of anisotropic magnetic powders described in Japanese Patent Application Kokai Publication Nos. 2001-181713 and 2002-217010, the magnetic powder contains a large amount of the magnetic powder with deteriorated surface or minute particles due to crushing is used. Consequently, the coercive force is sometimes decreased by the surface oxidation of such fine particles when the powder is heated to 280° C. or above, which is the melting point of PPS, or particularly to 320° C. or above. In the method of producing an anisotropic magnetic powder described in Japanese Patent Application Kokai Publication No. 2014-080653, the magnetic powder contains a large amount of particulate masses formed by sintering of particles and such particles are disassembled when the powder is kneaded with PPS. Consequently, the coercive force is decreased at times by the oxidation of the surfaces exposed by the breakage.

An object of the present exemplary embodiments is to provide a rare earth-iron-nitrogen anisotropic magnetic powder having good magnetic characteristics and heat resistance, and a method of producing such powders.

Method of Producing Anisotropic Magnetic Powders

Figure 1:
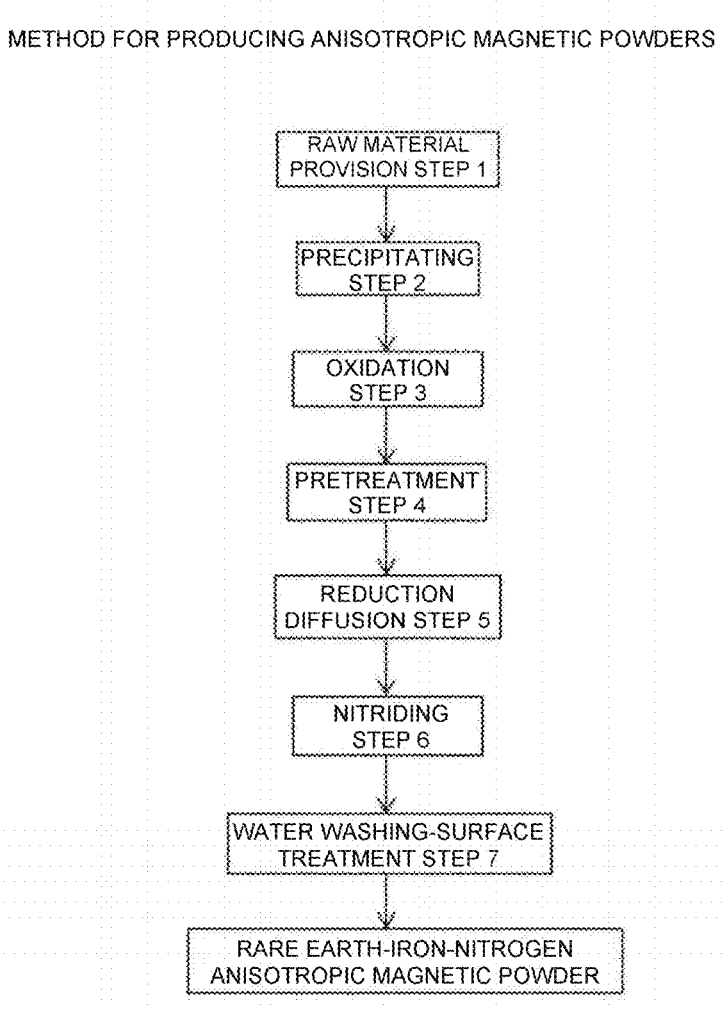
FIG. 1 is a view illustrating a schematic configuration of a method of producing anisotropic magnetic powders according to an embodiment.

FIG. 1 illustrates a method of producing anisotropic magnetic powders according to an exemplary embodiment. The description of the following production method is made with reference to FIG. 1.

The method of producing anisotropic magnetic powders according to the present embodiment includes a raw material provision step 1 of providing a solution including R (wherein R is at least one selected from the group consisting of Sc, Y, Pr, Nd, Pm, Sm, Gd, Tb, Dy, Ho, Er, Tm and Lu), iron and lanthanum, a precipitating step 2 of obtaining a precipitate containing R, iron and lanthanum from the solution, and an oxidation step 3 of obtaining an oxide containing R, iron and lanthanum from the precipitate. (Hereinbelow, the method will be described as "tungsten is absent or is not used" when these steps are carried out.) Instead of these steps, the method includes a raw material provision step 1 of providing a solution including R (wherein R is at least one selected from the group consisting of Sc, Y, Pr, Nd, Pm, Sm, Gd, Tb, Dy, Ho, Er, Tm and Lu), iron, lanthanum and tungsten, a precipitating step 2 of obtaining a precipitate containing R, iron, lanthanum and tungsten from the solution, and an oxidation step 3 of obtaining an oxide containing R, iron, lanthanum and tungsten from the precipitate. (Hereinbelow, the method will be described as "tungsten is present or is used" when these steps are carried out".)

In the present embodiment, in both cases where tungsten is used or not used, the method further includes a pretreatment step 4 of treating the oxide with a reducing gas to obtain a partial oxide, a reduction diffusion step 5 of obtaining alloy particles by reduction diffusion of the partial oxide at a temperature of not less than 920° C., and a nitriding step 6 of nitriding the alloy particles to produce an anisotropic magnetic powder represented by the following general formula:

$$R_{v-x}Fe_{(100-v-w-z)}N_wLa_xW_z$$

(wherein R is at least one selected from the group consisting of Sc, Y, Pr, Nd, Pm, Sm, Gd, Tb, Dy, Ho, Er, Tm and Lu, $3 \le v-x \le 30$, $5 \le w \le 15$, $0.08 \le x \le 0.3$, and $0 \le z \le 2.5$).

In the present embodiment, the precipitating step 2 is performed so as to form a precipitate containing lanthanum in a prescribed concentration so that x in the final anisotropic magnetic powder will be in the range of $0.08 \le x \le 0.3$. In the reduction diffusion step 5 after the oxidation step 3 and the pretreatment step 4, the partial oxide having the prescribed lanthanum concentration is reduced and diffused at 920° C. or above and lanthanum is melted and diffused. As a result, the reduction diffusion step 5 moderately promotes the growth of particles while suppressing the formation of minute particles, the formation of sintered minute particles, and the formation of coarse particles. Probably because of this, the anisotropic magnetic powder obtained in the nitriding step 6 attains excellent residual magnetic flux density.

When tungsten is used, similarly, the growth of particles is moderately promoted in the reduction diffusion step 5 while the formation of minute particles, the formation of sintered minute particles, and the formation of coarse particles are suppressed. In the reduction diffusion step 5, in addition, tungsten fills gaps between the particles and maintains the structure, which probably controls the excessive growth of particles by the action of lanthanum. Consequently, the anisotropic magnetic powder obtained in the nitriding step 6 can attain excellent coercive force and squareness ratio.

Hereinbelow, the exemplary embodiments of the steps will be described in further detail.

Raw Material Provision Step 1

A solution including R, iron and lanthanum is prepared by dissolving an R source, an iron source and a lanthanum source into a strongly acidic solution so that the target final composition will be obtained. When the main phase to be obtained is $Sm_2Fe_{17}N_3$, the molar ratio of R to Fe (R:Fe) is preferably in the range of 1.5:17 to 3.0:17, and more preferably in the range of 2.0:17 to 2.5:17.

The R source, the iron source and the lanthanum source are not limited as long as they can be dissolved into a strongly acidic solution. From the point of view of availability, for example, the R source may be an oxide of the metal, the Fe source may be $FeSO_4$, and the lanthanum source may be $LaCl_3$. The concentration of the solution including R, iron and lanthanum is controlled while still ensuring that the R source, the iron source and the lanthanum source will be substantially dissolved into the acidic solution. From the point of view of solubility, the acidic solution may be sulfuric acid. When tungsten is used, ammonium tungstate is an example tungsten source from the points of view of solubility and availability. When used, ammonium tungstate is dissolved into water in a concentration at which it is substantially dissolved, and this preparation takes place separately from the solution including R, iron and lanthanum.

Hereinbelow, an exemplary embodiment that does not use tungsten will be described. However, the following description applies equally to exemplary embodiments where tungsten is used.

Precipitating Step 2

The solution including R, iron and lanthanum is reacted with a precipitating agent, and thereby an insoluble precipitate containing R, iron and lanthanum is obtained. The precipitating agent is not limited as long as it is an alkaline solution (such as ammonia water or caustic soda) and can react with the solution including R, iron and lanthanum to allow a precipitate to be formed. Ammonia water is preferable in view of the fact that it is free from metal elements.

The precipitation reaction is preferably performed by dropping each of the solution including R, iron and lanthanum, and the precipitating agent into a solvent (preferably water). This manner of reaction is advantageous in that the properties of particles of the precipitate can be controlled. A precipitate having a uniform distribution of the constituent elements, a sharp particle size distribution and a uniform particle shape may be obtained by controlling the conditions such as the rates at which the solution including R, iron and lanthanum, and the precipitating agent are fed, the reaction temperature, the concentration of the reaction liquid, and the pH during the reaction. The use of such a precipitate enhances the magnetic characteristics of the final magnetic powder. The reaction temperature may be 0 to 50° C., and is preferably 35 to 45° C. The concentration of the reaction liquid in terms of the total concentration of metal ions is preferably 0.65 mol/L to 0.85 mol/L, and more preferably 0.7 mol/L to 0.85 mol/L. The pH during the reaction is preferably 5 to 9, and more preferably 6.5 to 8.

The particle size, particle shape and particle size distribution of the final magnetic powder substantially depend on the precipitating step 2. The size of the precipitate powder and the distribution thereof are preferably such that when the particle size is measured with a laser diffraction wet particle size distribution analyzer, substantially all the particles fall in the range of 0.05 to 20 μm, or more preferably 0.1 to 10 μm. The average particle size is measured as the particle size in a volume-based cumulative particle size distribution for which 50% of the particles are smaller, and is preferably in the range of 0.1 to 10 μm.

The precipitating step 2 may include a sub-step of separating and washing the precipitate obtained. The washing is performed until the conductivity of the supernatant solution falls to not more than 5 $mS/m^2$. The step of separating precipitate is for example, to separate the precipitate by admixing a solvent (preferably water) to the precipitate and subjecting the mixture to filtration, decantation or the like.

After being separated, the precipitate is preferably cleaned of the solvent in order to prevent the precipitate from being redissolved into the residual solvent during heat treatment in the subsequent oxidation step 3 to form aggregates, or to prevent changes in properties such as particle size distribution and particle size. Specifically, the solvent, for example, water may be removed by drying the precipitate in an oven at 70 to 200° C. for 5 hours to 12 hours.

Oxidation Step 3

In the oxidation step 3, the precipitate from the precipitating step 2 which includes R, iron and lanthanum is oxidized into an oxide containing R, iron and lanthanum. For example, the precipitate may be converted into an oxide by heat treatment. The heat treatment of the precipitate needs to take place in the presence of oxygen, and may be performed in, for example, air atmosphere. Because oxygen should be present, it is preferable that the precipitate include oxygen atoms as nonmetallic constituents.

The temperature of the heat treatment may be 700 to 1300° C., and the treatment time may be several hours. Preferably, the heat treatment is performed at a temperature of 900 to 1200° C. for several hours (for example, 1 to 3 hours).

The oxide obtained from the precipitate is oxide particles in which R, iron and lanthanum are sufficiently mixed together microscopically within the oxide particles and which reflect the properties of the precipitate such as shape and particle size distribution.

Pretreatment Step 4

In the pretreatment step 4, the oxide obtained in the oxidation step 3 is heat treated in a reducing atmosphere created by a reducing gas and is partly reduced to give a partial oxide. The reducing gas is selected from, among others, hydrogen ($H_2$), carbon monoxide (CO) and hydrocarbon gases such as methane ($CH_4$). From the point of view of cost, hydrogen gas is preferable. In this case, the temperature of the heat treatment is preferably set to the range of 300 to 900° C., and is more preferably set to the range of 400 to 800° C. Heat treatment at 300° C. or above allows the reduction of Fe oxide to proceed efficiently. Heat treatment at 900° C. or below prevents the oxide particles from growing or segregating, and thus makes it possible to maintain the desired particle size.

When hydrogen is used as the reducing gas, it is preferable that the thickness of the oxide layer subjected to the pretreatment step 4 be controlled to not more than 20 mm and the dew point of the atmosphere in the reaction furnace be controlled to not more than −10° C.

Reduction Diffusion Step 5

In the reduction diffusion step 5, the partial oxide obtained in the pretreatment step 4 by the partial reduction of the oxide containing R, iron and lanthanum is mixed together with metallic calcium, and the mixture is heat treated in an atmosphere of an inert gas except nitrogen such as of argon, or in vacuum to form alloy particles including R, iron and lanthanum. The partial oxide is reduced and diffusion takes place by the contact of the partial oxide with the calcium melt or calcium vapor.

In the reduction diffusion treatment, the heat treatment temperature is preferably in the range of 920 to 1200° C., more preferably in the range of 950 to 1200° C., and particularly preferably in the range of 1000 to 1100° C. While the diffusion of lanthanum takes place as long as the temperature is set to or above 920° C. which is the melting point of lanthanum, the temperature is preferably 950° C. or above to ensure sufficient diffusion. Limiting the temperature to not more than 1200° C. suppresses the formation of masses by the sintering of multiple particles, and thus makes it possible to maintain heat resistance.

To ensure that the reduction reaction will take place more uniformly, the heat treatment time in the reduction diffusion treatment may be in the range of 10 minutes to 10 hours, and is preferably in the range of 10 minutes to 2 hours.

The metallic calcium is used in the form of grains or powder. The particle size thereof is preferably not more than 10 mm to ensure that aggregation during the reduction diffusion reaction will be prevented more effectively. The metallic calcium may be added in an amount that is 1.1 to 3.0 times, or preferably 1.5 to 2.0 times greater than the reaction equivalent weight (the stoichiometric amount that is necessary to reduce the rare earth oxide and, if any, when Fe is in the form oxide, to reduce it).

In the reduction diffusion step 5, the metallic calcium as the reductant may be used in combination with a disintegrant. The disintegrant is used to facilitate the disintegration and granulation of the product in a washing step described later. Examples of disintegrants that may be used include alkaline earth metal salts such as calcium chloride and alkaline earth oxides such as calcium oxide. The disintegrant is used in a ratio of 1 to 30 mass %, or preferably 5 to 30 mass % relative to the rare earth oxide used as the rare earth source.

Nitriding Step 6

In the nitriding step 6, the alloy particles obtained in the reduction diffusion step 5 are nitrided to give anisotropic magnetic particles. Because the particles in the present embodiment are the particulate precipitate formed in the precipitating step 2, instead of fusing metals, the alloy particles obtained in the reduction diffusion step 5 are porous masses, can be directly heat treated in a nitrogen atmosphere in the nitriding step 6 without being crushed. Thus, uniform nitriding is feasible.

The alloy particles are nitrided in such a manner that the temperature is decreased from the temperature used for the reduction reaction to a temperature of 300 to 600° C. or in particular 400 to 550° C., and the atmosphere is purged with nitrogen at a temperature in the above range. The heat treatment time in the nitriding treatment is not limited as long as the alloy particles can be sufficiently uniformly nitrided, and is, for example, about 2 to 30 hours.

Water Washing-Surface Treatment Step 7

The product resulting from the nitriding step 6 sometimes includes, in addition to the magnetic particles, impurities such as CaO byproduct and unreacted metallic calcium, and is often in the form of sintered masses that are a complex of these substances. In such a case, a water washing-surface treatment step 7 may be performed in which the product is added into cool water to cause CaO and metallic calcium to be suspended as calcium hydroxide ($Ca(OH)_2$) and to separate them from the magnetic particles. The calcium hydroxide still remaining after such separation may be removed sufficiently by washing the magnetic particles with a medium such as acetic acid. When the product is added into water, the oxidation of metallic calcium with water and the hydration of CaO byproduct induce the disintegration of the reaction product from the sintered complex masses into fine particles. Next, a phosphoric acid solution as the agent for surface treatment is added in an amount in the range of 0.10 to 10 wt % in terms of $PO_4$ relative to the solids of the magnetic particles obtained in the nitriding step 6. The particles are separated from the solution and dried. An anisotropic magnetic powder is thus obtained.

Anisotropic Magnetic Powders

Next, anisotropic magnetic powders obtained by the above-discussed production method will be described.

An anisotropic magnetic powder according to the present embodiment is represented by the following general formula (hereinafter, also written simply as "formula"):

$$R_{v-x}Fe_{(100-v-w-z)}N_wLa_xW_z$$

(wherein R is at least one selected from the group consisting of Sc, Y, Pr, Nd, Pm, Sm, Gd, Tb, Dy, Ho, Er, Tm and Lu, $3 \le v-x \le 30$, $5 \le w \le 15$, $0.08 \le x \le 0.3$, and $0 \le z \le 2.5$), and, as analyzed under dry conditions on a laser diffraction particle size distribution analyzer, has an average particle size of not less than 3.5 μm and not more than 6.2 μm, a particle size D10 of not less than 1.6 μm and not more than 2.8 μm, a particle size D50 of not less than 3.5 μm and not more than 5.7 μm, and a particle size D90 of not less than 6.0 μm and not more than 9.5 μm, and has a span defined below of not more than 1.25:

$$\text{Span}=(D90-D10)/D50$$

wherein D90, D10 and D50 are particle sizes corresponding to 90%, 10% and 50%, respectively, in a cumulative particle size distribution.

The average particle size, D10, D50 and D90 are determined with a laser diffraction particle size distribution analyzer. The average particle size indicates the average value in a volume-based distribution, and D10, D50 and D90 are particle sizes corresponding to 10%, 50% and 90%, respectively, in the accumulation of the frequencies in the volume-based distribution.

By controlling the average particle size and the particle sizes D10, D50 and D90 to the prescribed values or above so that the particles include few minute particles, enhancements in residual magnetic flux density and heat resistance may be obtained. By controlling the average particle size and the particle sizes D10, D50 and D90 to the prescribed values or below so that the particles include few coarse particles having a multiple magnetic domain structure, the residual magnetic flux density may be enhanced.

Further, magnetic characteristics and heat resistance may be enhanced by controlling the span to the specific value or less so that the particle size distribution is sharp and the particle shapes are uniform.

In the formula, the ratio of R is limited to not less than 3 atom % and not more than 30 atom %. If the ratio is less than 3 atom %, an unreacted iron component (α-Fe phase) is separated and the nitride decreases its coercive force and fails to serve as a practical magnet. If the ratio is above 30 atom %, the at least one element selected from the group consisting of Sc, Y, Pr, Nd, Pm, Sm, Gd, Tb, Dy, Ho, Er, Tm and Lu is precipitated and the magnetic powder becomes unstable in the air and decreases the residual magnetic flux density. The ratio of nitrogen is limited to not less than 5 atom % and not more than 15 atom %. If the ratio is less than 5 atom %, little coercive force is exhibited. Adding more than 15 atom % nitrogen results in the formation of nitrides of iron and the at least one element selected from the group consisting of Sc, Y, Pr, Nd, Pm, Sm, Gd, Tb, Dy, Ho, Er, Tm and Lu. From the point of view of magnetic characteristics, a preferred composition assuming that R is Sm and z=0 may be represented by $Sm_{9.1}Fe_{77.2}N_{13.55}La_{0.15}$, and one assuming that z>0 may be represented by $Sm_{9.0}Fe_{76.9}N_{13.6}La_{0.16}W_{0.34}$.

In the formula, it is preferable from the point of view of magnetic characteristics that x be in the range of $0.08 \le x \le 0.3$, more preferably in the range of $0.11 \le x \le 0.22$, and particularly preferably in the range of $0.15 \le x \le 0.19$. From the point of view of magnetic characteristics, z is preferably in the range of $0 \le z \le 2.5$.

The circularity is measured with a scanning electron microscope and RYUUSHI KAISEKI (Particle Analysis) Ver. 3 by NIPPON STEEL & SUMIKIN TECHNOLOGY Co., Ltd. as an image analysis software. A 3000× SEM image is binarizing image processed and the circularity is determined with respect to individual particles. The circularity in the disclosure, is the average of circularities obtained by the measurement of about 1000 to 10000 particles.

In general, the circularity is increased with increasing proportion of small particles. Thus, the circularity was measured with respect to particles having sizes of 1 μm and above. In the measurement of circularity, the defined equation: Circularity=(4ΠS/L2) is used in which S is the two-dimensional projected area of the particle, and L is the two-dimensional projected boundary length.

The average of circularities is preferably not less than 0.50. If the circularity is below 0.50, fluidity is decreased and the particles undergo stress between particles during magnetic field pressing, which results in a decrease in magnetic characteristics.

When z=0 in the formula, the residual magnetic flux density of not less than 127 $Am^2/g$ and the coercive force of the anisotropic magnetic powder of not less than 10 kOe are preferably and, respectively. In this case, the anisotropic magnetic powder has sufficient magnetic characteristics and may be used for bond magnets.

When z>0 in the formula, the anisotropic magnetic powder preferably has a residual magnetic flux density of not less than 119 $Am^2/g$, a coercive force of not less than 17 kOe, and Hk of not less than 6 kOe. In this case, the magnetic characteristics are enough for the anisotropic magnetic powder to be used for bond magnets.

Composite Materials

Hereinbelow, composite materials and bond magnets will be described.

The composite material is prepared from the anisotropic magnetic powder described hereinabove, and a resin. By virtue of the incorporation of the anisotropic magnetic powder, the composite material attains high magnetic characteristics.

The resin present in the composite material may be a thermosetting resin or a thermoplastic resin, but is preferably a thermoplastic resin. Specific examples of the thermoplastic resins include polyphenylene sulfide resins (PPS), polyether ether ketones (PEEK), liquid crystal polymers (LCP), polyamides (PA), polypropylenes (PP) and polyethylenes (PE).

In the preparation of the composite material, the mixing ratio of the anisotropic magnetic powder and the resin (resin/magnetic powder) is preferably 0.10 to 0.15, and more preferably 0.11 to 0.14.

For example, the composite material may be obtained by mixing the anisotropic magnetic powder and the resin with each other at 280 to 330° C. using a kneader.

Bond Magnets

A bond magnet may be produced using the composite material. Specifically, for example, a bond magnet may be obtained by aligning the easy axes of magnetization by the application of an orientation field while heating the composite material (the orientation step), and magnetizing the material by the application of a pulsed magnetizing field (the magnetization step).

For example, the heating temperature in the orientation step is preferably 90 to 200° C., and more preferably 100 to 150° C. For example, the magnitude of the orientation field in the orientation step may be 720 kA/m.

The magnitude of the magnetizing field in the magnetization step may be, for example, 1500 to 2500 kA/m.

EXAMPLES

Hereinbelow, additional exemplary embodiments will be described. Unless otherwise mentioned, "%" is on mass basis in the following description.

Example 1

Raw Material Provision Step 1

An Fe—Sm sulfuric acid solution was prepared in the following manner. $FeSO_4.7H_2O$ 5.0 kg was added to pure water 2.0 kg and was dissolved therein. Further, there were added $Sm_2O_3$ 0.49 kg, 31.8% $LaCl_3$ 0.048 kg and 70% sulfuric acid 0.74 kg. The mixture was stirred sufficiently to give a complete solution. Next, pure water was added to the solution to adjust the final concentrations of Fe to 0.726 mol/l, Sm to 0.112 mol/l and La to 0.0064 mol/l. An Fe—Sm—La sulfuric acid solution was thus prepared.

Precipitating Step 2

While performing stirring, the Fe—Sm—La sulfuric acid solution obtained in the raw material provision step 1 was added dropwise to 2 kg of pure water kept at 35° C. At the same time, 15% ammonia water was dropped to control the pH to 7 to 8. Thus, a slurry containing Fe—Sm—La hydroxide was obtained. The slurry obtained was washed by decantation with pure water, and thereafter the hydroxide was recovered by solid liquid separation. The hydroxide separated was dried in an oven at 100° C. for 10 hours.

Oxidation Step 3

The hydroxide obtained in the precipitating step 2 was calcined in the air at 1000° C. for 1 hour. After cooling, red Fe—Sm—La oxide was obtained as a raw material powder.

Pretreatment Step 4

100 g of the Fe—Sm—La oxide obtained above was added into a steel container to a bulk height of 10 mm. The container was placed into a furnace, and the pressure was decreased to 100 Pa. While introducing hydrogen gas, the temperature was increased to 770° C. and was held constant for 15 hours.

In this manner, a black partial oxide was obtained in which the oxygen bonded to Sm remained not being reduced whilst 95% of the oxygen bonded to Fe had been reduced.

Reduction Diffusion Step 5

60 g of the partial oxide obtained in the pretreatment step 4, and 19.2 g of metallic calcium having an average particle size of about 6 mm were mixed with each other. The mixture was placed into a furnace.

After the furnace was evacuated to vacuum, argon gas (Ar gas) was introduced. The temperature was increased to 1045° C. and was held constant for 2 hours. Thus, Fe—Sm—La alloy particles were obtained.

Nitriding Step 6

Subsequently, the furnace was cooled to an inside temperature of 100° C. and was evacuated to vacuum. While introducing nitrogen gas, the temperature was increased to 450° C. and was held constant for 23 hours. The product thus obtained was masses including magnetic particles.

Water Washing-Surface Treatment Step 7

The product obtained in the nitriding step 6 was added to 3 kg of pure water, and the mixture was stirred for 30 minutes and was allowed to stand. The supernatant was removed by decantation. The addition to pure water, stirring and decantation were repeated ten times.

Next, 2.5 g of 99.9% acetic acid was added, and the mixture was stirred for 15 minutes and was allowed to stand. The supernatant was removed by decantation. The addition to pure water, stirring and decantation were repeated two times.

A phosphoric acid solution was added to the resultant slurry. The amount of the phosphoric acid solution was 1 wt % in terms of $PO_4$ relative to the solids of the magnetic particles. The mixture was stirred for 5 minutes. The solids were separated by solid liquid separation and were vacuum dried at 80° C. for 3 hours. Thus, a magnetic powder represented by $Sm_{9.2}Fe_{77.1}N_{13.59}La_{0.11}$ was obtained.

Evaluation

Magnetic Characteristics

The magnetic particles obtained by the production method described in Examples were packed into a sample vessel together with a paraffin wax. The paraffin wax was melted with a dryer. Thereafter, the easy axes of magnetization were aligned by the application of an orientation field of 16 kA/m. The oriented sample was pulse magnetized by the application of a magnetizing field of 32 kA/m. The residual magnetic flux density, the coercive force and the squareness ratio were measured with a VSM (vibrating sample magnetometer) having a maximum field of 16 kA/m.

Examples 2 to 4

Magnetic powders were obtained in the same manner as in Example 1, except that the amount of $LaCl_3$ used in the raw material provision step 1 was changed so that the ratio of lanthanum in the composition would be as described in Table 1.

Comparative Example 1

Raw Material Provision Step 1

An Fe—Sm sulfuric acid solution was prepared in the same manner as in Example 1, except that $LaCl_3$ was not added in the raw material provision step 1.

Precipitating Step 2 to Water Washing-Surface Treatment Step 7

A magnetic powder was obtained by repeating the procedures described in Example 1.

Example 5

Raw Material Provision Step 1

First, an Fe—Sm—La sulfuric acid solution was prepared in the same manner as in Example 1.

Precipitating Step 2

While performing stirring, the Fe—Sm—La sulfuric acid solution obtained in the raw material provision step 1 was added dropwise to 2 kg of pure water kept at 35° C. At the same time, 15% ammonia water and 201.8 g of 12.5% ammonium tungstate were dropped to control the pH to 7 to 8. Thus, a slurry containing Fe—Sm—La—W hydroxide was obtained. The slurry obtained was washed by decantation with pure water, and thereafter the hydroxide was recovered by solid liquid separation. The hydroxide separated was dried in an oven at 100° C. for 10 hours.

Oxidation Step 3 to Water Washing-Surface Treatment Step 7

A magnetic powder was obtained by repeating the procedures described in Example 1. The magnetic powder obtained was represented by $Sm_{9.2}Fe_{77.1}N_{13.55}La_{0.11}W_{0.12}$.

Examples 6 to 8

Magnetic powders were obtained in the same manner as in Example 5, except that the amounts of $LaCl_3$ and ammonium tungstate used in the raw material provision step 1 and the precipitating step 2 were changed so that the ratios of lanthanum and tungsten in the composition would be as described in Table 1.

Comparative Example 2

Raw Material Provision Step 1

A Sm—Fe sulfuric acid solution was prepared in the same manner as in Comparative Example 1.

Precipitating Step 2

While performing stirring, the Fe—Sm sulfuric acid solution obtained in the raw material provision step 1 was added dropwise to 2 kg of pure water kept at 35° C. At the same time, 15% ammonia water and 202 g of 12.5% ammonium tungstate were dropped to control the pH to 7 to 8. Thus, a slurry containing Fe—Sm—W hydroxide was obtained. The slurry obtained was washed by decantation with pure water, and thereafter the hydroxide was recovered by solid liquid separation. The hydroxide separated was dried in an oven at 100° C. for 10 hours.

Oxidation Step 3 to Water Washing-Surface Treatment Step 7

A magnetic powder was obtained by repeating the procedures described in Example 1.

Comparative Examples 3 to 10

Magnetic powders were obtained in the same manner as in Example 1, except that the amount of $LaCl_3$ used in the raw material provision step 1 was changed so that the ratio of lanthanum in the composition would be as described in Table 1.

TABLE 1

| | Weight percentages | | | | Composition | | | | Residual magnetic flux density | Coercive force | Squareness ratio |
|---|---|---|---|---|---|---|---|---|---|---|---|
| | Sm (%) | Fe (%) | La (%) | W (%) | Sm | Fe | La | W | ($Am^2/kg$) | (Oe) | (Oe) |
| Example 1 | 23.6 | 73.3 | 0.25 | — | 9.2 | 77.1 | 0.11 | — | 128.9 | 10930 | 3681 |
| Example 2 | 23.8 | 72.4 | 0.37 | — | 9.5 | 76.8 | 0.16 | — | 132.0 | 13540 | 3981 |
| Example 3 | 23.1 | 71.9 | 0.34 | — | 9.1 | 77.2 | 0.15 | — | 134.3 | 13380 | 4058 |
| Example 4 | 23.3 | 71.8 | 0.52 | — | 9.3 | 76.9 | 0.22 | — | 130.5 | 13556 | 3963 |
| Example 5 | 22.7 | 70.7 | 0.29 | 0.36 | 9.2 | 77.0 | 0.13 | 0.12 | 120.5 | 17340 | 6399 |
| Example 6 | 22.6 | 72.2 | 0.36 | 0.57 | 9.0 | 77.1 | 0.15 | 0.18 | 120.0 | 17241 | 7457 |
| Example 7 | 22.6 | 70.8 | 0.32 | 0.83 | 9.1 | 76.9 | 0.14 | 0.27 | 123.0 | 18571 | 8574 |
| Example 8 | 22.7 | 71.8 | 0.37 | 1.04 | 9.0 | 76.9 | 0.16 | 0.34 | 120.7 | 20000 | 8662 |
| Comparative Example 1 | 24.0 | 74.5 | — | — | 9.1 | 77.3 | — | — | 127.1 | 13720 | 5603 |
| Comparative Example 2 | 23.3 | 73.2 | — | 0.90 | 9.1 | 77.3 | — | 0.27 | 113.9 | 22264 | 9108 |
| Comparative Example 3 | 22.4 | 69.9 | 0.17 | — | 9.2 | 77.1 | 0.08 | — | 124.6 | 12230 | 3699 |
| Comparative Example 4 | 23.2 | 73.4 | 0.73 | — | 9.1 | 77.0 | 0.31 | — | 123.4 | 5816 | 1405 |
| Comparative Example 5 | 23.1 | 73.6 | 0.79 | — | 9.0 | 77.1 | 0.33 | — | 125.4 | 5534 | 1376 |
| Comparative Example 6 | 23.3 | 73.3 | 0.82 | — | 9.1 | 77.0 | 0.35 | — | 123.4 | 5644 | 1371 |
| Comparative Example 7 | 22.9 | 74.6 | 0.93 | — | 8.8 | 77.2 | 0.39 | — | 124.9 | 5709 | 1398 |
| Comparative Example 8 | 22.6 | 73.8 | 0.90 | — | 8.8 | 77.2 | 0.38 | — | 119.0 | 6028 | 1429 |
| Comparative Example 9 | 22.6 | 73.6 | 1.04 | — | 8.8 | 77.1 | 0.44 | — | 126.0 | 5698 | 1455 |
| Comparative Example 10 | 22.7 | 73.8 | 1.03 | — | 8.8 | 77.1 | 0.43 | — | 123.1 | 5725 | 1379 |

As shown in Table 1, the anisotropic magnetic powders of Examples 1 to 4 outperformed those of Comparative Example 1 and Comparative Examples 3 to 10 in terms of residual magnetic flux density, coercive force and squareness ratio. Further, the anisotropic magnetic powders of Examples 5 to 8 attained excellent coercive force and squareness ratio as compared to those of Comparative Example 2 and Comparative Examples 3 to 10 while ensuring the similar level of residual magnetic flux density.

Table 2 describes the magnetic characteristics of some of the powders of Examples and Comparative Examples after being calcined in the air at 320° C. for 30 minutes.

TABLE 2

| | Before calcination in air | | | After calcination in air at 320° C. for 30 min | | |
|---|---|---|---|---|---|---|
| | Residual magnetic flux density ($Am^2/kg$) | Coercive force (Oe) | Squareness ratio (Oe) | Residual magnetic flux density ($Am^2/kg$) | Coercive force (Oe) | Squareness ratio (Oe) |
| Example 2 | 132.0 | 13540 | 3981 | 124.2 | 10380 | 3078 |
| Example 3 | 134.3 | 13380 | 4058 | 124.3 | 10010 | 2875 |
| Example 7 | 123.0 | 18571 | 8574 | 116.1 | 14850 | 3716 |
| Comparative Example 1 | 133.6 | 12930 | 5474 | 64.5 | 4791 | 1126 |
| Comparative Example 2 | 113.9 | 22264 | 9108 | 89.4 | 11190 | 3358 |

As shown in Table 2, the anisotropic magnetic powders of Examples 2 and 3 had small decreases in residual magnetic flux density, coercive force and squareness ratio after calcination in air as compared to Comparative Example 1, and were thus demonstrated to have excellent heat resistant characteristics.

Further, the anisotropic magnetic powder of Example 7 had small decreases in residual magnetic flux density, coercive force and squareness ratio after calcination in air as compared to Comparative Example 2, and were thus demonstrated to have excellent heat resistant characteristics.

Figure 2:
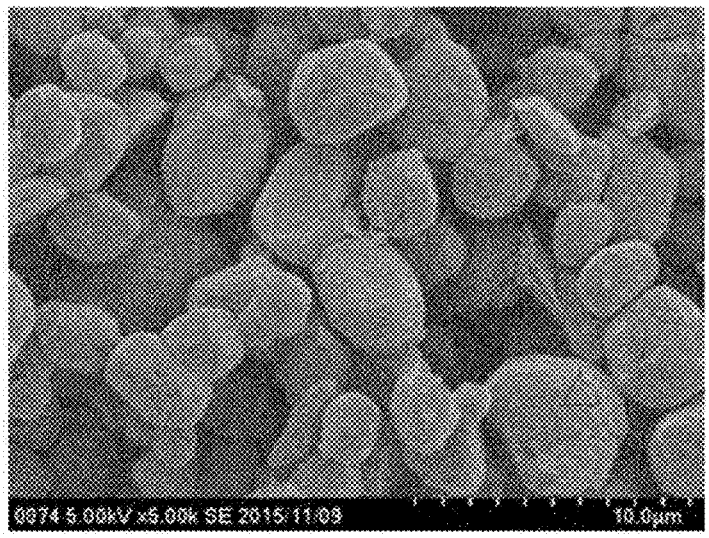
FIG. 2 is an SEM image of a magnetic powder in Example 2.
Figure 3:
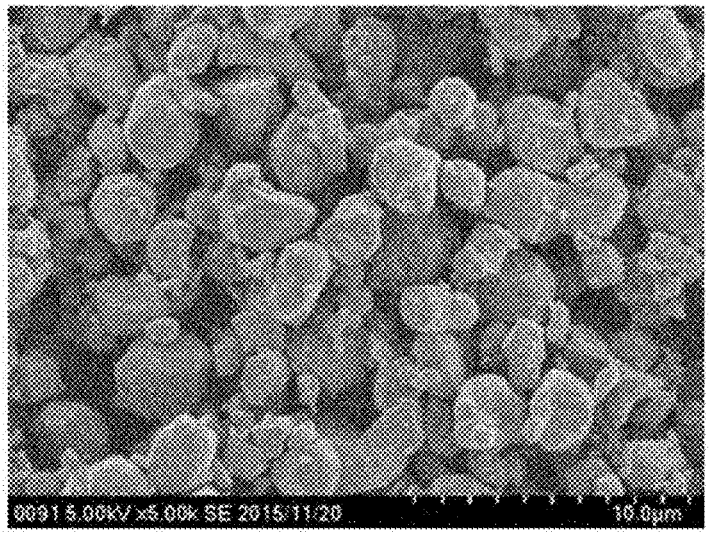
FIG. 3 is an SEM image of a magnetic powder in Comparative Example 1.

FIG. 2 and FIG. 3 are SEM images of the anisotropic magnetic powders of Example 2 and Comparative Example 1, respectively. It has been confirmed that the anisotropic magnetic powder in FIG. 2 contained fewer minute particles and there were fewer sintered multiple particles as compared to the powder in FIG. 3.

Figure 4:
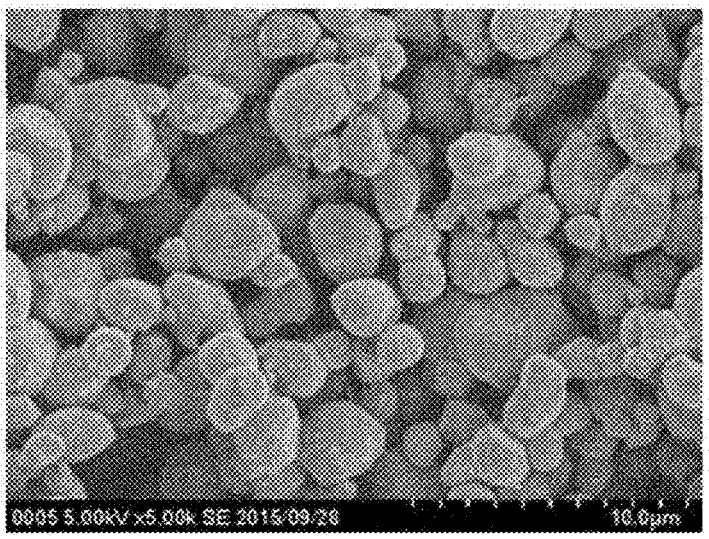
FIG. 4 is an SEM image of a magnetic powder in Example 8.
Figure 5:
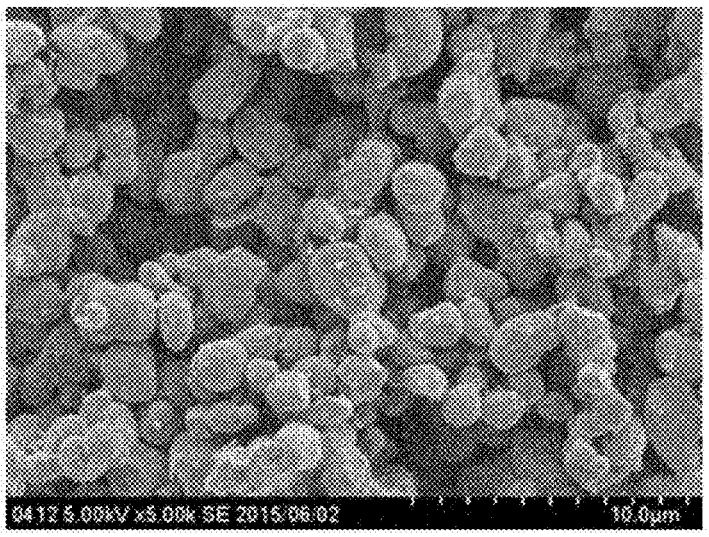
FIG. 5 is an SEM image of a magnetic powder in Comparative Example 2.

FIG. 4 and FIG. 5 are SEM images of the anisotropic magnetic powders of Example 8 and Comparative Example 2, respectively. It has been confirmed that the anisotropic magnetic powder in FIG. 4 contained fewer minute particles and there were fewer sintered multiple particles as compared to the powder in FIG. 5.

Figure 6:
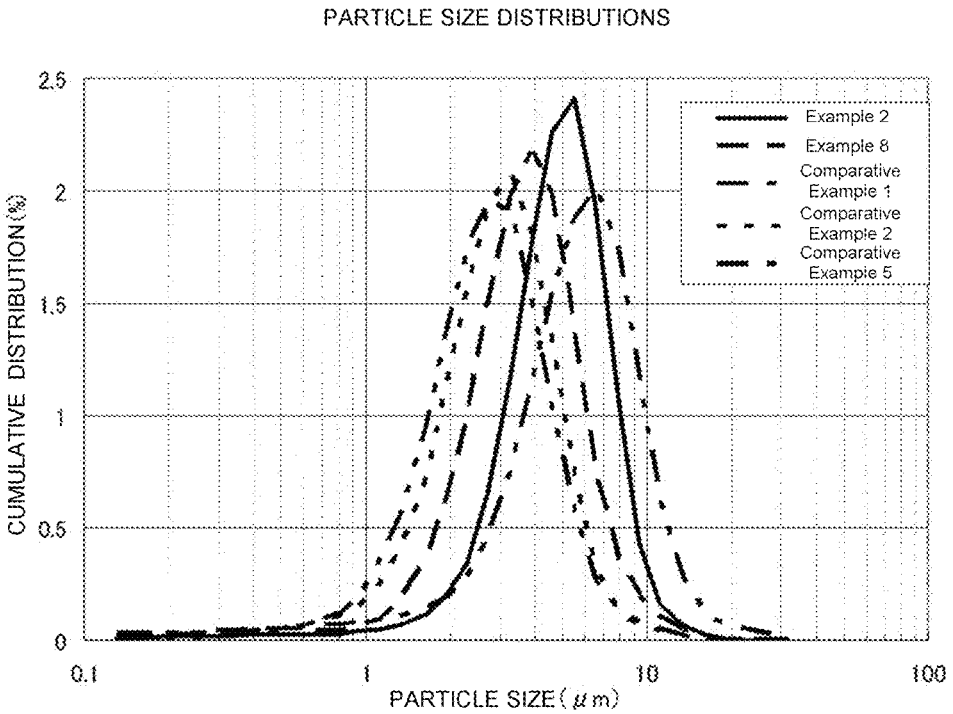
FIG. 6 is a diagram illustrating the particle size distributions (frequency distributions) of magnetic powders in Examples 2 and 8 and Comparative Examples 1, 2 and 5.

The particle size distributions of Examples 2 and 8 and Comparative Examples 1, 2 and 5 are illustrated in FIG. 6. The values of D10, D50, D90 and span are described in Table 3.

TABLE 3

| | D10 | D50 | D90 | Span | Average particle size | Residual magnetic flux density ($Am^2/kg$) |
|---|---|---|---|---|---|---|
| Example 2 | 2.7 | 4.9 | 7.8 | 1.04 | 5.1 | 132.0 |
| Example 8 | 1.9 | 3.7 | 6.3 | 1.21 | 4.0 | 120.7 |
| Comparative Example 1 | 1.3 | 2.7 | 4.9 | 1.30 | 3.0 | 127.1 |
| Comparative Example 2 | 1.4 | 3.0 | 5.1 | 1.23 | 3.2 | 113.9 |
| Comparative Example 5 | 3.0 | 6.0 | 10.0 | 1.18 | 6.3 | 125.4 |

From Table 3 and FIG. 6, the anisotropic magnetic powder of Example 2 had larger D10, D50, D90 and average particle size and a smaller span than the powder of Comparative Example 1. That is, the formation of minute particles or sintered multiple particles was suppressed and the particle size distribution was sharp, which resulted in a high residual magnetic flux density.

Further, the anisotropic magnetic powder of Example 2 had smaller D10, D50, D90 and average particle size and a smaller span than the powder of Comparative Example 5. That is, the formation of coarse particles having a multiple magnetic domain structure was suppressed and the particle size distribution was sharp, which resulted in a high residual magnetic flux density.

The anisotropic magnetic powder of Example 8 had larger D10, D50, D90 and average particle size than the powder of Comparative Example 2. That is, the formation of minute particles or sintered multiple particles was suppressed, and consequently a high residual magnetic flux density was obtained.

Table 4 describes the circularity of the anisotropic magnetic powders of Examples 2 and 7 and Comparative Examples 1 and 2.

TABLE 4

| | 1 μm or larger particles Circularity |
|---|---|
| Example 2 | 0.50 |
| Example 7 | 0.53 |
| Comparative Example 1 | 0.38 |
| Comparative Example 2 | 0.39 |

The anisotropic magnetic powders of Examples 2 and 7 had higher circularity than the powders of Comparative Examples 1 and 2. Thus, improved fluidity will be attained and it makes the stress between particles during magnetic field pressing suppressed, giving rise to an expectation that magnetic characteristics will be improved.

INDUSTRIAL APPLICABILITY

The composite materials and bond magnets using the anisotropic magnetic powders of the present disclosure, are excellent in heat resistance and have high coercive force. Thus, these materials and magnets may be used in, for example, high-temperature applications such as automotive motors and water pumps, among other applications.

All publications, patent applications, and technical standards mentioned in this specification are herein incorporated by reference to the same extent as if each individual publication, patent application, or technical standard was specifically and individually indicated to be incorporated by reference.

Although the present disclosure has been described with reference to several exemplary embodiments, it shall be understood that the words that have been used are words of description and illustration, rather than words of limitation. Changes may be made within the purview of the appended claims, as presently stated and as amended, without departing from the scope and spirit of the disclosure in its aspects. Although the disclosure has been described with reference to particular examples, means, and embodiments, the disclosure may be not intended to be limited to the particulars disclosed; rather the disclosure extends to all functionally equivalent structures, methods, and uses such as are within the scope of the appended claims.

One or more examples or embodiments of the disclosure may be referred to herein, individually and/or collectively, by the term "disclosure" merely for convenience and without intending to voluntarily limit the scope of this application to any particular disclosure or inventive concept. Moreover, although specific examples and embodiments have been illustrated and described herein, it should be appreciated that any subsequent arrangement designed to achieve the same or similar purpose may be substituted for the specific examples or embodiments shown. This disclosure may be intended to cover any and all subsequent adaptations or variations of various examples and embodiments. Combinations of the above examples and embodiments, and other examples and embodiments not specifically described herein, will be apparent to those of skill in the art upon reviewing the description.

In addition, in the foregoing Detailed Description, various features may be grouped together or described in a single embodiment for the purpose of streamlining the disclosure. This disclosure may be not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter shall be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure may be determined by the broadest permissible interpretation of the following claims and their equivalents, and shall not be restricted or limited by the foregoing detailed description.

What is claimed is:

1. A method of producing anisotropic magnetic powders comprising:

obtaining a precipitate containing an element R, iron and lanthanum from a solution including R, iron and lanthanum, wherein R is at least one selected from the group consisting of Sc, Y, Pr, Nd, Pm, Sm, Gd, Tb, Dy, Ho, Er, Tm and Lu;

oxidizing the precipitate into an oxide containing R, iron and lanthanum;

treating the oxide with a reducing gas to obtain a partial oxide;

obtaining alloy particles by reduction diffusion of the partial oxide at a temperature in the range of 920° C. to 1200° C.; and nitriding the alloy particles to produce anisotropic magnetic powders represented by the following general formula:

$$R_{v-x}Fe_{(100-v-w-z)}N_wLa_xW_z$$

where $9.0 \le v-x \le 9.5$, $5 \le w \le 15$, $0.15 \le x \le 0.22$, and $0 \le z \le 2.5$, wherein the anisotropic magnetic powders have an average particle size of not less than 3.5 μm and not more than 6.2 μm;

wherein the anisotropic magnetic powders have a particle size D10 of not less than 1.6 μm and not more than 2.8 μm;

wherein the anisotropic magnetic powders have a particle size D50 of not less than 3.5 μm and not more than 5.7 μm;

wherein the anisotropic magnetic powders have a particle size D90 of not less than 6.0 μm and not more than 9.5 μm; and wherein the anisotropic magnetic powders have a span of not more than 1.25 according to the following equation:

$$\text{Span}=(D90-D10)/D50$$

where D90 corresponds to 90%, D10 corresponds to 10%, and D50 corresponds to 50% in a cumulative particle size distribution, wherein a residual magnetic flux density of the anisotropic magnetic powders is not less than 128.9 $Am^2/g$, and a coercive force of the anisotropic magnetic powders is not less than 10 kOe, and z is 0.

2. The method of producing anisotropic magnetic powders according to claim 1, wherein R is Sm.

3. The method of producing anisotropic magnetic powders according to claim 1, wherein x is in the range of $0.15 \le x \le 0.19$.

4. The method of producing anisotropic magnetic powders according to claim 1, wherein in the obtaining alloy particles, the reduction diffusion of the partial oxide is performed at a temperature in the range of 950° C. to 1200° C.

5. The method of producing anisotropic magnetic powders according to claim 1, wherein a circularity of the anisotropic magnetic powders according to the following equation is not less than 0.5, $$\text{Circularity}=(4\Pi S/L2),$$

wherein S is a two-dimensional projected area of the particle, and L is a two-dimensional projected boundary length.

6. The method of producing anisotropic magnetic powders according to claim 1, wherein R is at least one selected from the group consisting of Sc, Y, Nd, Pm, Sm, Gd, Tb, Dy, Ho, Er, Tm and Lu.

* * * * *